United States Patent [19]

Boisrayon et al.

[11] 4,031,840

[45] June 28, 1977

[54] PROCESS AND APPARATUS FOR RECOVERING SUNKEN WRECKS

[75] Inventors: Gerald Marc Albert Boisrayon, Clamart; Gilbert Marius Henri Martin, La Seyne, both of France

[73] Assignee: Etat Francais, France

[22] Filed: Dec. 19, 1975

[21] Appl. No.: 642,591

[30] Foreign Application Priority Data

Jan. 24, 1975 France ..... 74.02195

[52] U.S. Cl. ..... 114/51; 43/6; 114/16.8

[51] Int. Cl.² ..... B63C 7/02

[58] Field of Search ..... 114/50, 51, 16.4, 16.8, 114/44; 43/6; 9/9

[56] References Cited

UNITED STATES PATENTS

| | | | |
|---|---|---|---|
| 1,393,894 | 10/1921 | McGill | 114/51 |
| 1,491,984 | 4/1924 | Cowles | 114/51 |
| 1,811,241 | 6/1931 | Morey | 114/16.8 |
| 2,347,690 | 5/1944 | Kannenberg | 114/51 |
| 3,039,410 | 6/1962 | Rimar | 43/6 |
| 3,102,525 | 9/1963 | Englis | 43/6 |
| 3,210,880 | 10/1965 | Grenier | 43/6 |
| 3,680,243 | 8/1972 | Braun | 43/6 |

*Primary Examiner*—Trygve M. Blix
*Assistant Examiner*—Stuart M. Goldstein
*Attorney, Agent, or Firm*—Stevens, Davis, Miller & Mosher

[57] ABSTRACT

The present disclosure relates to a method and apparatus for recovering sunken wrecks. More particularly, the present invention concerns a method and apparatus for recovering sunken wrecks wherein a harpoon is launched from a submarine device, implants itself in the wreck and is provided with a rope and means for fastening a pull cable. The end of the rope which is remote from the harpoon is floated to the surface. An apparatus placed at the end of the pull cable is caused to descend along the rope, and at the end of the stroke the apparatus automatically fastens itself to the harpoon. Thereupon, the wreck is pulled up by means of the pull cable.

10 Claims, 8 Drawing Figures

PROCESS AND APPARATUS FOR RECOVERING SUNKEN WRECKS

BACKGROUND OF THE INVENTION

I. Field of the Invention

This invention relates to a method of recovering sunken wrecks and an apparatus for the carrying out of the method. More specifically, the technical field of the invention is that of marine equipment and sighting apparatus for the refloating of sunken objects.

II. Description of the Prior Art

The customary methods of recovering wrecks at the bottom of the sea employ various means of clamping the object, such as grapnels.

It has also been contemplated using foam as material, as this offers the advantage of not damaging the wreck. Air-inflated plastic pockets have been produced for the refloating of sunken objects. One great disadvantage is the necessity of using frogmen for the carrying out of the operations following the locating in order to connect the wreck to the pulling device and then effect its withdrawal.

The stages of locating, fastening and pulling are therefore separate and not coordinated. To remove a wreck from the water requires time, labor and special equipment.

SUMMARY OF THE INVENTION

The object of the present invention is to provide a method and apparatus which simplify these operations by reducing the amount of the time, labor and equipment factors and afford numerous advantages. This object is achieved by a method which is defined by the following steps:

From an underwater device a harpoon is launched which embeds itself in the wreck, said harpoon being provided with means for fastening a pulling cable and with a rope rigidly connected to a float which rises to the surface. A device placed at the end of said pull cable is caused to descend along said rope and fasten itself automatically at the end of its stroke to said hooking means and said wreck then is withdrawn by means of said pull cable.

The apparatus for the carrying out of the method comprises a harpoon fastened to the end of a rope and an apparatus for launching said harpoon which is carried by an underwater device, said apparatus comprising a float rigidly connected with a reel on which said rope is wound, the two being fastened removably to said device.

The said harpoon is provided with a part for the automatic fastening of a pull cable, which part has the shape of a male tip threaded over one end of said rope and connected to said harpoon by a piece of flexible pull cable.

The arrangement furthermore comprises a compressed air gun for the launching of said harpoon located along the axis of said float and of said reel with which it is rigidly connected, said float being cylindrical and maintained secured to the outside of the hull of said submarine device by at least one detachable belt.

A control is furthermore provided within the submarine device by means of a hydraulic jack for the launching of said harpoon first and thereupon for the freeing of said float.

For the operation of removing the wreck, there is provided at the end of the pull cable, a device for automatic fastening to said male tip, formed of a hollow body threaded over said rope and to which the pull cable is fastened, said hollow body containing a sliding sleeve threaded over said cable which fits said male tip and has means for automatic locking onto the latter.

The result of the invention is a new method and apparatus for the recovering of sunken wrecks.

The main advantage of the invention is that it simplifies the operations and the equipment employed in the recovery of sunken wrecks and affords a saving in time and in labor.

The float, which is rigidly connected with the reel holding the rope which is fastened to the harpoon at one end, detaches itself from the submarine device shortly after the launching of said harpoon, permitting both the marking on the surface and the guidance up to the wreck, as a result of said rope.

The device for the automatic fastening of the pull cable to the hooking part with which said harpoon is provided, since it is adapted to slide along the said rope, does not require the presence of a frog man for the hooking.

Once the refloating has been effected, the launching apparatus and the harpoon are recovered and again fastened to the outside of the submarine device where they are ready to be used again, without requiring any special care.

Other features and advantages of the invention will become better understood from the reading of the following description of one embodiment, referring to the accompanying drawings.

DETAILED DESCRIPTION OF THE PREFERRED EMBODIMENT

Figure 1:
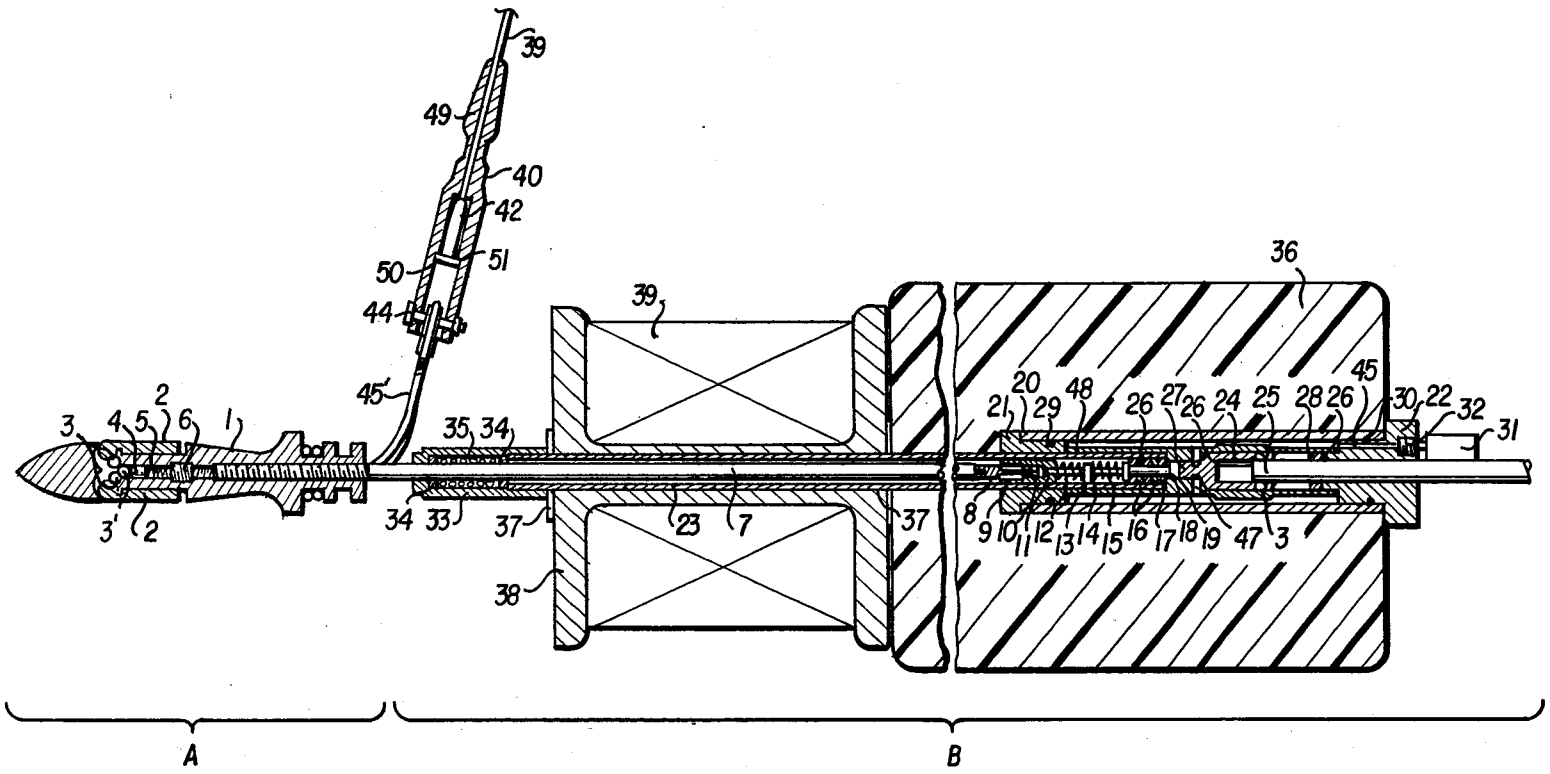
FIG. 1 is a longitudinal section through a portion of the apparatus in accordance with the invention.

FIG. 1 is a longitudinal section through a portion of the apparatus in accordance with the invention comprising on the one hand the harpoon A and on the other hand the launching apparatus B.

The harpoon A itself is comprised of the arrow tip 1 extended by three barbs the neck of which is clamped over balls 3. The body of the harpoon contains axially a headless screw 6 against which there rests one end of a spring 5 whose other end contacts a push member 4. The latter, moved forward by the pressure exerted upon the firing, pushes back an axial ball 3' moving away the other balls 3 and, therefore, the barbs.

The tip 1 is extended by an arrow coaxial with the gun of the launching apparatus B. The retaining head 8 of the arrow is held locked to the launching piston the forward portion of which comprises a coaxial sleeve 9, via two balls 10, each being housed in a recess provided in the wall of the said shaft. A spring 12 holds the sleeve 9 in arrow locking position.

The shaft 11 is screwed into the body of the piston 14 whose rear portion bears a sealing assembly comprising alternately a scraper ring of plastic material 16 and a joint 17, this assembly contacting the inner wall of the gun 23. The sealing assembly is held on the shoulder of the body of the piston 14 by means of a metal washer 18 which is locked by a lock ring 19 which is housed in a circular groove in the body of the piston 14.

The body of the piston 14 is provided with a brace 13 whose front face serves as support for the locking spring 12 of the arrow and whose rear face serves as support for the shock absorbing spring 15.

The rear of the gun barrel 23 is surrounded by a sleeve of generally cylindrical shape 21 whose inside diameter narrows down at the end of said gun to constitute a shoulder against which the washer 18 of the launching piston 14 strikes. An annular ring 26 serves as joint between the portions 21 and 23. The said sleeve 21 has its wall thickened toward the outside at the front end, forming a plug for the circular cavity 48 defined by said sleeve on the one hand and a cylindrical body 20 on the other hand. The annular ring 29 assures tightness between the two parts 20 and 21.

The cavity 48 serves as compressed air reservoir which constitutes the source of power for the launching of the harpoon. It communicates with the gun 23 by means of three recesses 47 drilled uniformly in the wall of the sleeve 21 on the rear of the shoulder which serves as stop for the launching piston. The rear of the cavity 48 is closed by means of plug 22 which closes the portions 20 and 21 by fitting into the sleeve 21 and screwing itself in the body 20. The tightness of the chamber at the rear is assured between the plug 22 and the sleeve 21 by means of the annular ring 26, and between the body 20 and the sleeve 21 by means of the annular ring 30.

The charging of the cavity 48 with compressed air is assured by the channel 45 drilled in the plug 22 which is provided with a rapid filling connection 31.

The seal between the cavity 48 and the gun 23 is assured by means of a differential slide or piston of unequal section 24 provided with annular sealing rings 26 and 27.

When the cavity 48 is charged with compressed air, the difference in the pressures which act on the front and rear sections of the slide tend to move the slide 24 back towards the rear.

The slide is normally locked by balls 3 of a diameter greater than the thickness of the rear portion of the slide 24.

The holding of these balls in locking position is assured by a rod 25 which slides in the plug 22 and penetrates into the rear portion of the slide 24. Between the slide 24 and the plug 22 there is arranged a washer 28 which serves as shock absorber for the movement of the slide during firing.

In the tip 33 of the gun there is located a spring 35 engaged between two washers 34 which serve as shock absorbers. At the rear end of the said tip and around the gun a washer 37 assures the holding in place of a reel 38 around which there is wound up a rope 39 one end of which is connected to the harpoon.

A cylindrical float 36 which is separated from the reel by another washer 37 forms an extension of the said reel, first surrounding the gun, and then the body 20 whose plug 22 holds the said float in place.

A rope 39 is connected to the harpoon via a fastening piece 40. The latter has the shape of a longitudinally and coaxially hollowed male tip 49 so as to permit the passage, with slight play, of said rope. The male tip is extended by a cylindrical sleeve of larger outside and inside diameters, which sleeve encloses a part 42 which retains the end of said rope engaged firmly. The said part 42 flares out at its end opposite the male tip to form a rim 50 which strikes against an inner narrowing 51 of the wall of the fastening part 40 when the said rope is pulled on.

The fastening part 40 is connected to the harpoon A by a piece of flexible pull cable 45.

Figure 2:
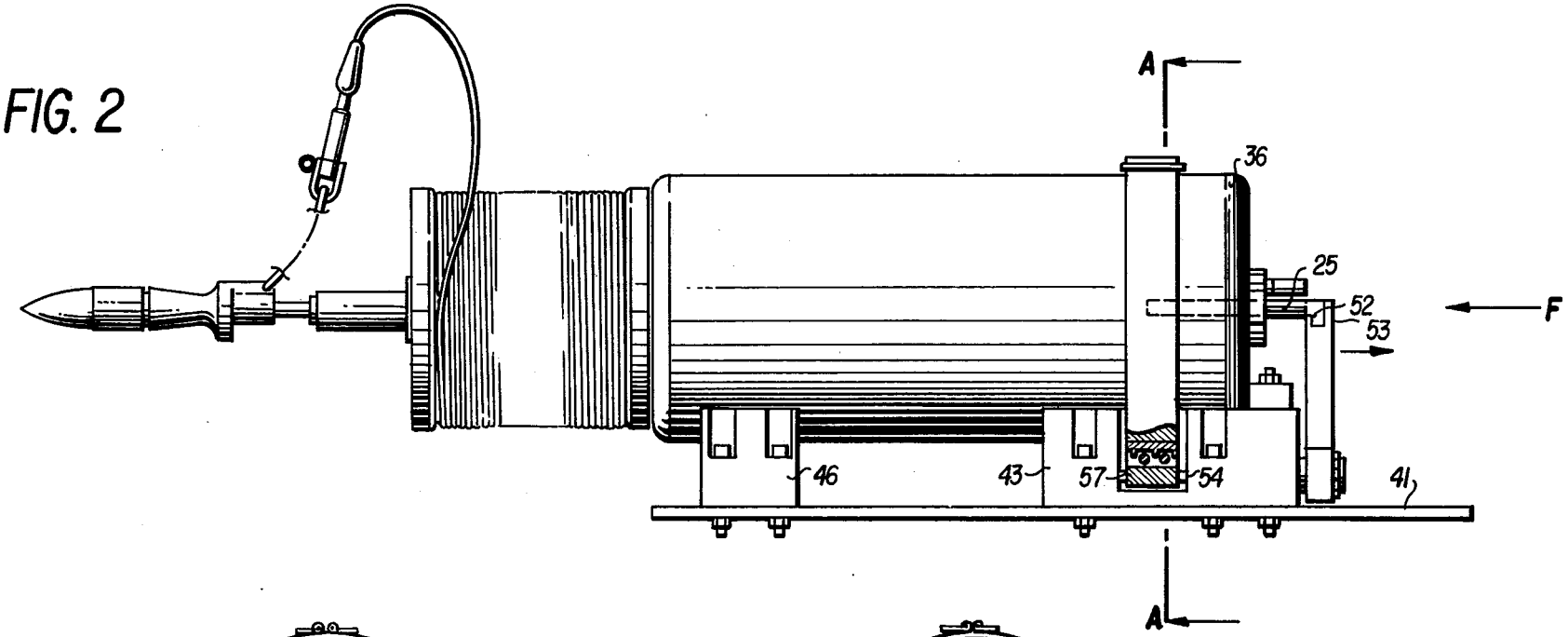
FIG. 2 is an overall view of the apparatus after being fastened to the submarine device.
Figure 4:
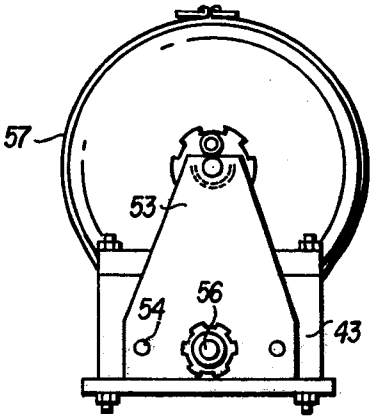
FIG. 4 is a section along the line F—F of FIG. 2.
Figure 3:
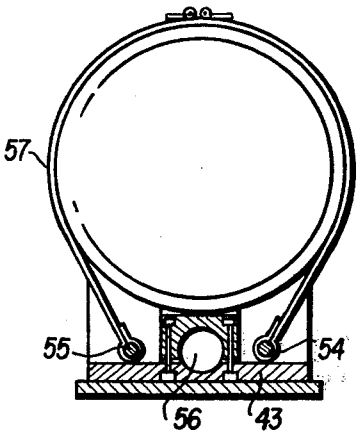
FIG. 3 is a section along line A—A of FIG. 2.
Figure 5A:
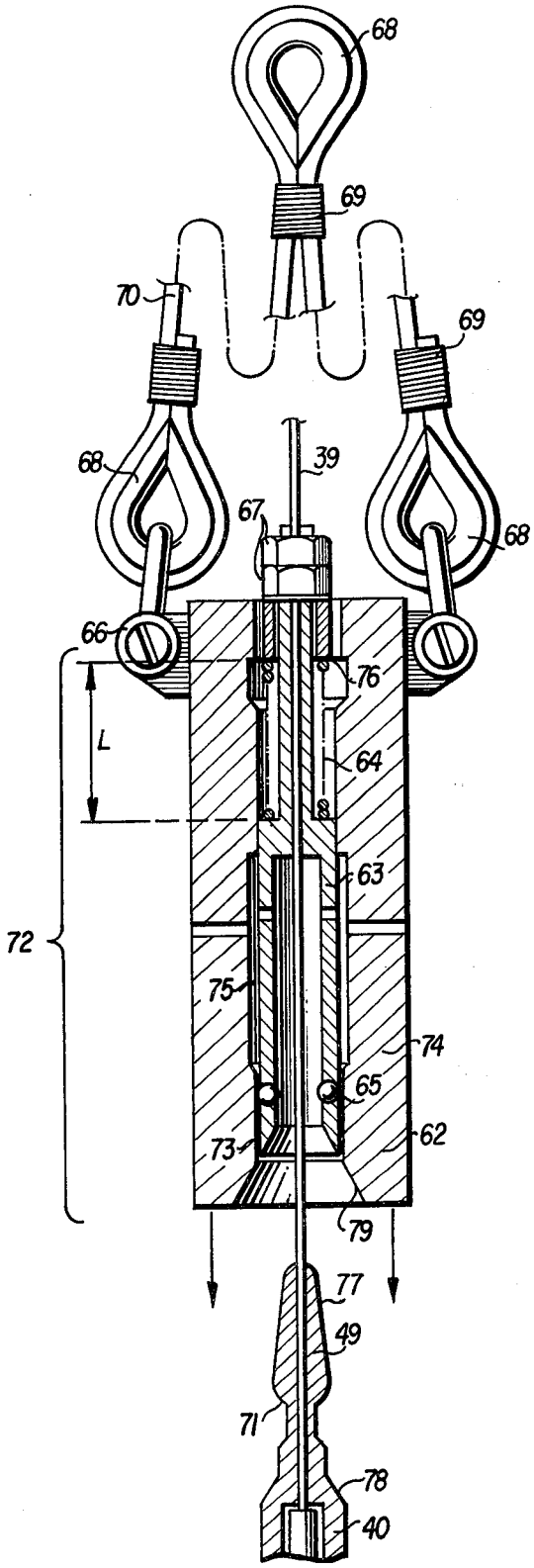
FIGS. 5, A, B, C, and D are longitudinal sections through the automatic hooking part and fastening device, showing the main phases leading to the connecting of the harpoon to the pull cable.
Figure 5B:
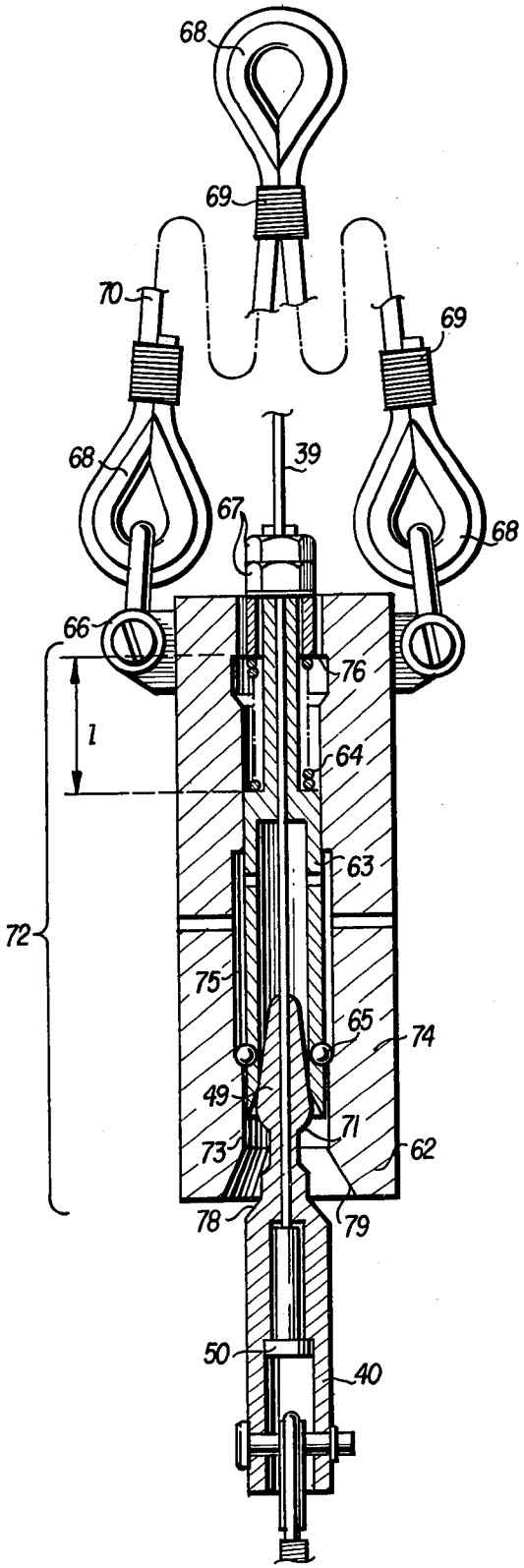
Figure 5C:
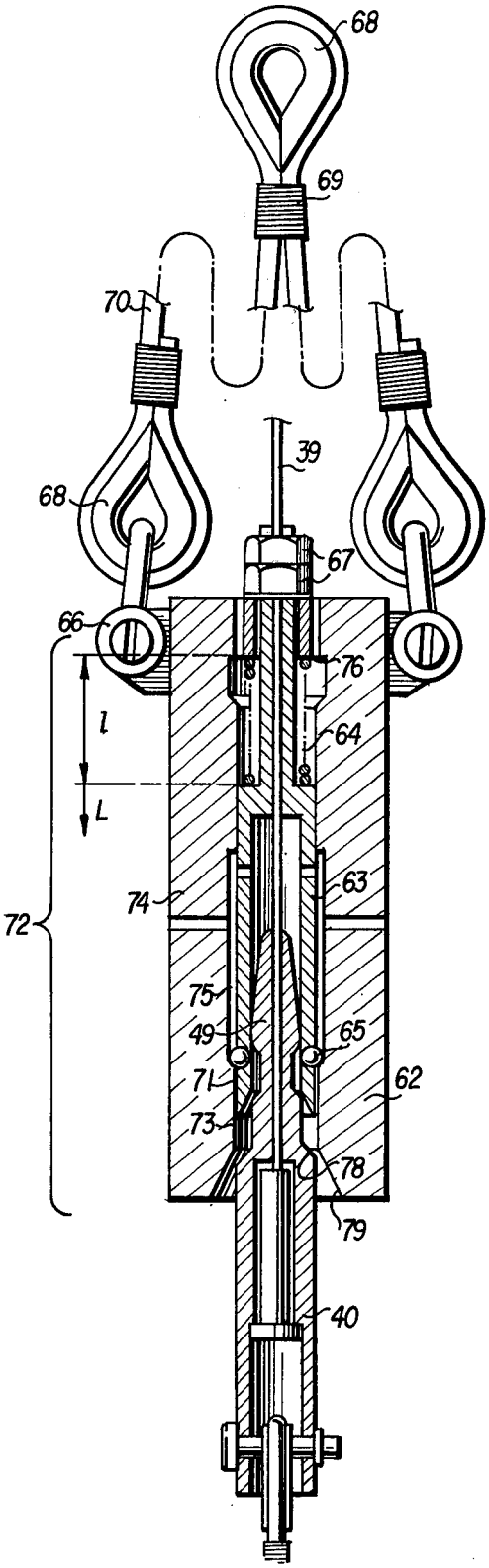
Figure 5D:
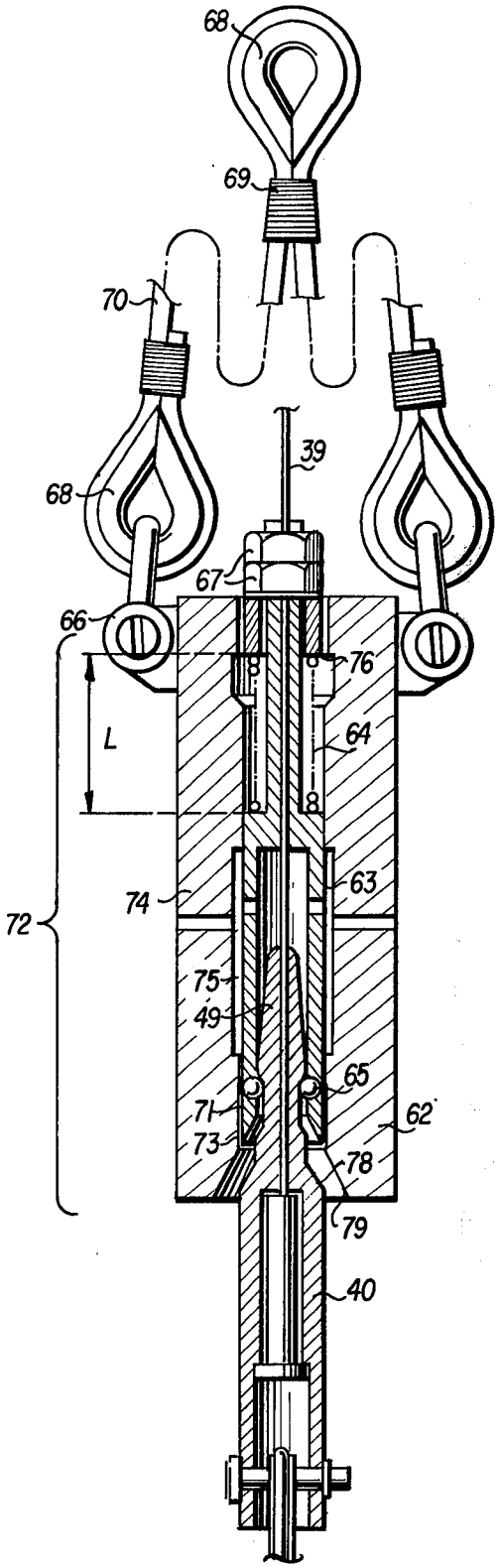

FIG. 2 shows an overall view of the apparatus, once fastened to the submarine device, and FIGS. 3 and 4 are sections along A—A and F—F respectively of FIG. 2.

A support plate 41 for the launching apparatus B and main cradle 43 and secondary cradle 46 are placed against the hull on the outside of the submarine by means well known to the man skilled in the art. The launching apparatus is then fastened to it by means of at least one strap 57 in the following manner:

The strap 57 surrounds the float 36. Each end of this strap forms a loop around a rod 54. The longitudinal axis of each rod is parallel to the axis of the launching apparatus. A ring 55 holds the strap around the said rod in fixed position. The strap is held closed by any means known to the man skilled in the art, such as a fastening plate and jacks, which is an example cited merely for purposes of illustration and not of limitation.

Furthermore, a jack 56 with longitudinal axis parallel to the axis of the launching apparatus is provided. The movement of the piston of the said jack controls the movement of the movable sear 53 in the direction indicated by the arrow shown in FIG. 2, as well as the movement of the rods 54 which are movable in the same direction.

The firing mechanism breaks down schematically as follows:

1. The jack 56 is placed in operation.

2. First of all, the movable sear 53 moves back, driving with it the firing finger 52 which is an extension of the rod 25. The latter, by its rearward retraction releases the balls 3. The differential piston or slide 24 is free to move rearward of the stop 19 and up to the shock absorber 28.

The compressed air can then exert a pressure on the rear face of the launching piston 14. Under the effect of the thrust, the arrow and the intermediate part extending it to the rear are propelled foward at very high speed and are stopped by the stop at the end of the tip of the gun 33. An impact takes place then which, due to its violence, causes the unlocking of the arrow from the sleeve in which it was locked up to that time. The harpoon which has implanted itself in the wreck which was sighted is then connected with the launching apparatus only by the rope 39.

3. The freeing of the arrow having been rapidly effected it is followed by the freeing of the straps 57. This takes place, one the movable rods 54 have been sufficiently displaced in order no longer to hold them, by the recoil of the movable sear 53. The launching apparatus B has a float which then rises to the surface.

FIGS. 5 A, B, C, and D show in longitudinal sections the main stages leading to the fastening of the pull cable to the harpoon.

In FIG. 5 A there is shown an automatic fastening device 72 which is sliding over the rope 39 and is approaching the fastening part 40.

The fastening device 72 has a cylindrical hollow body 74 which has a recess 73 before flaring at its end closest to the fastening part 40. This body 74 is provided at its other end with at least two anchoring points 66 for the thimbles 68 intended for metal pull cables 70 connected at 69. The pull is thus exerted at several points of said body.

Within said body there is movably mounted a sleeve 63 which is hollowed axially over its entire length so that the rope passes through it will a small amount of play.

The movement of said sleeve is limited, towards the pulling cable, by a stop 76 formed of a narrowing of the inner wall of the body 74. A spring 64 rests on the one end against said stop and on the other end against the sleeve 63 having a decrease in diameter. Near the front end of said sleeve there are provided, in one and the same plane, at least two recesses in which there are housed balls 65 of a diameter greater than the thickness of the wall of said sleeve at that point. The balls can therefore protrude from the wall towards the inside or outside of said sleeve.

The space defined by the balls, when they restrict the inner entrance of the sleeve, prevents the passage of the male tip 49 at its shoulder 71.

In FIG. 5 A, before the fastening, it will be noted that the spring 64 is of maximum length L and that the balls are then located in the recess 73 and will stop the shoulder 71 when the device 72 is allowed to slide up to the part 40. The rope 39 being held taut in the direction of the arrow shown in FIG. 5 B, the device 72 hooked to the end of the pull cable continues to slide under the effect of its weight. The conical bearing surface 77 of the part 40 rests against the balls 65 and pushes back the sleeve 53 the movement of which compresses the spring 64 the length of which decreases and becomes 1. The balls 65 then arrive into the cavity 75 and can move freely towards the outside of the sleeve (FIG. 5 B). This takes place under the thrust which the conical bearing surface 77 of the tip 49 exerts.

The retraction of the balls permits the tip 49 to penetrate completely into the sleeve 63 and the device 72 to continue to descend under the effect of its weight until the conical shoulder 78 of the part 40 comes against the flare 79 of the body 74.

At the same time, as soon as the shoulder 71 has arrived in the cavity 75 and has passed in front of the balls 65, the spring 64 which tends to resume its normal length L, lengthens in the direction of the arrows pushing the sleeve 63 and, from there, the balls.

The latter, in order to follow the narrowing of the wall of the body 74 are forced towards the inside of the sleeve. This movement, indicated by the arrows in FIG. 5 C, explains the automatic locking of the fastening part 40.

This locking is illustrated in FIG. 5 D after the movement of the sleeve 63 is effected in the direction of the arrow. The spring has again found its original length L. The recess 73 prevents the movement of the balls towards the outside of the sleeve.

When a lifting force is exercised on the pull cable, the rising of the assembly 72 applies the shoulder 71 against the balls which assure an effective locking. The pulling force exerted on the body 74 of the assembly 72 is transmitted to the sleeve 63 via two nuts 67 screwed on to the threaded end of said sleeve, and then to the part 40 via the balls 65 and then to the harpoon which is implanted in the wreck by means of the flexible pull cable.

Of course various modifications can be made by the man skilled in the art in the process and apparatus described, without going beyond the scope of the invention, the said process and apparatus having been described solely by way of illustration and not of limitation.

What is claimed is:

1. An apparatus for recovering sunken wrecks from the water, said apparatus comprising:

a. a harpoon fastened to one end of a rope by means of a fastening part connected to the harpoon, said fastening part formed, at one end, as a male tip;

b. a submarine gun provided with a hull and adapted to be connected to a submarine vehicle;

c. a harpoon launching apparatus borne by said submarine gun, which comprises a float rigidly connected with a reel on which the other end of said rope is wound, both being removably fastened to said gun and;

d. a device for the automatic fastening onto said male tip, formed by a hollow body which is threaded over said rope, said device having a pull cable fastened thereto.

2. An apparatus as claimed in claim 1, wherein said male tip is connected to said harpoon by a length of flexible pull cable.

3. An apparatus as claimed in claim 1, in which said submarine gun is actuated by compressed air for the launching of said harpoon, said harpoon being located along the axis of said float and said reel to which it is rigidly connected.

4. An apparatus as claimed in claim 3, wherein said float is cylindrical and held fixed to the end of the hull of said submarine gun by at least one detachable strap, and, wherein at least one end of said strap forms a loop in which there is engaged a sliding rod, the displacement of which frees said strap.

5. An apparatus as claimed in claim 4, including a hydraulic jack driven from the inside of said device and the displacement of which controls, in succession, the launching of said harpoon and the displacement of said sliding rods.

6. An apparatus as claimed in claim 5, wherein said device for triggering the departure of the harpoon is formed of a rod sliding within a differential piston which it normally holds in locked position, said piston is placed at the rear end of said gun and its movement, after unlocking, unmasks the compressed-gas inlet orifices at the rear of said gun.

7. An apparatus as claimed in claim 1, wherein said hollow body contains a sliding sleeve threaded over said cable, which sleeve fits on said male tip and has means for automatic locking onto it.

8. An apparatus as claimed in claim 7, wherein said locking means are formed of balls housed in peripheral recesses of said sleeve and engage behind the shoulder of said male tip.

9. An apparatus as claimed in claim 7, wherein the said sliding sleeve is pushed by a spring towards the lower end of said body and comprises a stop which limits its stroke in this direction.

10. An apparatus as claimed in claim 9, wherein said body comprises, around said sliding sleeve, a recess, the lower end of which is placed slightly above the position occupied by said balls when said sleeve is butting so that said balls retract into said recess when the sliding sleeve is pushed back against said spring in contact with said male tip.

* * * * *